US010019922B2

(12) United States Patent
Lee et al.

(10) Patent No.: US 10,019,922 B2
(45) Date of Patent: Jul. 10, 2018

(54) DISPLAY DEVICE THAT ADJUSTS THE LEVEL OF A REFERENCE GAMMA VOLTAGE USED FOR GENERATING A GAMMA VOLTAGE

(71) Applicant: Samsung Display Co., Ltd., Yongin-si (KR)

(72) Inventors: Jeongbong Lee, Hwaseong-si (KR); Hee-un Ku, Daejeon (KR); Kyungmo Lee, Seoul (KR); Siyoung Choi, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 122 days.

(21) Appl. No.: 14/876,390

(22) Filed: Oct. 6, 2015

(65) Prior Publication Data

US 2016/0203769 A1 Jul. 14, 2016

(30) Foreign Application Priority Data

Jan. 13, 2015 (KR) ..... 10-2015-0006134

(51) Int. Cl.
*G09G 3/36* (2006.01)
*G09G 3/20* (2006.01)

(52) U.S. Cl.
CPC ..... *G09G 3/20* (2013.01); *G09G 2310/027* (2013.01); *G09G 2320/0673* (2013.01); *G09G 2370/08* (2013.01)

(58) Field of Classification Search
CPC ..... G09G 2310/027; G09G 2310/0291; G09G 2310/0297; G09G 2310/08; G09G 3/20; G09G 3/3406; G09G 3/2003; G09G 2330/028; G09G 3/36; G09G 5/00; G11C 19/00; G02F 1/1345; G06F 3/038
See application file for complete search history.

(56) References Cited

U.S. PATENT DOCUMENTS 8,730,214 B2 5/2014 Kim et al.
8,823,616 B2 9/2014 Kim et al.
2009/0066622 A1* 3/2009 Yang ..... G09G 3/3688 345/89

(Continued)

FOREIGN PATENT DOCUMENTS

KR 10-0671517 1/2007
KR 10-2007-0043360 4/2007

(Continued)

*Primary Examiner* — Pegeman Karimi
(74) *Attorney, Agent, or Firm* — H.C. Park & Associates, PLC

(57) ABSTRACT

A display device including a plurality of source drivers. Each of the .plurality of source drives may include a register storing information on a bias voltage provided from the outside; a gamma voltage generation unit receiving at least one reference gamma voltage and generating a plurality of gamma voltages according to the reference gamma voltage; and an output buffer including a plurality of source amplifiers driven by the bias voltage and receiving the plurality of gamma voltages. The gamma voltage generation unit may adjust a level of at lest one of the at least one reference gamma voltage, according to a bias voltage having the lowest level among bias voltages provided to respective source drivers.

12 Claims, 8 Drawing Sheets

(56) References Cited

U.S. PATENT DOCUMENTS

| | | | | |
|---|---|---|---|---|
| 2009/0135116 | A1* | 5/2009 | Chang | G09G 3/3696 345/87 |
| 2011/0043506 | A1* | 2/2011 | Peng | G09G 3/3655 345/211 |
| 2014/0117998 | A1 | 5/2014 | Hwang et al. | |
| 2014/0118322 | A1* | 5/2014 | Kim | G09G 3/3233 345/212 |

FOREIGN PATENT DOCUMENTS

| | | |
|---|---|---|
| KR | 10-2008-0024863 | 3/2008 |
| KR | 10-2008-0087525 | 10/2008 |
| KR | 10-0952378 | 4/2010 |

* cited by examiner

DISPLAY DEVICE THAT ADJUSTS THE LEVEL OF A REFERENCE GAMMA VOLTAGE USED FOR GENERATING A GAMMA VOLTAGE

CROSS-REFERENCE TO RELATED APPLICATION

This application claims priority from and the benefit of Korean Patent Application No. 10-2015-0006134, filed on Jan. 13, 2015, which is hereby incorporated by reference for all purposes as if fully set forth herein.

BACKGROUND

Field

Exemplary embodiments relate to a display device, and more particularly, to a display device that may adjust the level of a reference gamma voltage used for generating a gamma voltage.

Discussion of the Background

In general, a display device includes a display panel including a plurality of pixels displaying an image, a gate driver providing gate signals to the plurality of pixels, and a source driver providing data signals to the plurality of pixels.

Increases in the number of pixels of a display device and in the size of a display panel are modern trends. As a result, the display device generally includes a plurality of drivers. However, because the transmission paths of bias voltages applied to the plurality of source drivers and the magnitudes of the impedances of the transmission paths are also different from one another, the sizes of bias voltages received by respective source drivers may be different from one another. Because the magnitudes of the bias voltages are different from one another, the magnitudes of the gamma voltages and the grayscale voltages generated by the plurality of source drivers are also different from one another as a result.

A display device generated by a chip-on-glass (COG) may increase the number of film-on-glasses (FOG) in order to solve such a limitation. However, such an arrangement tends to increase the unit price of a product, thereby decreasing the competitiveness of the product. Thus, enabling the plurality of source drivers to generate gamma voltages having the same magnitudes by supplying uniform bias voltages to the plurality of source drivers without an increase in number of FOGs is being emphasized as an important issue.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a display device that adjusts the levels of reference gamma voltages used for generating a gamma voltage to allow source drivers to output reference gamma voltages all having the same level.

Additional aspects will be set forth in the detailed description which follows, and, in part, will be apparent from the disclosure, or may be learned by practice of the inventive concept.

An exemplary embodiment discloses a display device including a plurality of source drivers, wherein each of the source drivers includes a gamma voltage generation unit driven by a bias voltage and configured to generate a plurality of gamma voltages by using at least one reference gamma voltage. At least one of the at least one reference gamma voltage is adjusted with reference to level information regarding a reference bias voltage, the reference bias voltage being a bias voltage having a lowest level among bias voltages provided to the plurality of source drivers.

The gamma voltage generation unit may further include a decoder configured to adjust a level of at least one of the at least one reference gamma voltage with reference to the level information regarding the reference bias voltage.

A level of the adjusted reference gamma voltage may be lower than a level of a reference gamma voltage prior to adjustment.

A level of the plurality of gamma voltages generated by the gamma voltage generation unit may be the same as a level of the plurality of gamma voltages generated by the gamma voltage generations of other source drivers.

A level of at least one reference gamma voltage provided to a source driver receiving a bias voltage having a same level as the reference bias voltage may not be adjusted.

The gamma voltage generation unit may further comprise: a plurality of amplifiers configured to receive and output the adjusted reference gamma voltage or the at least one reference gamma voltage; and a plurality of resistors connected to output ends of the plurality of amplifiers and dividing output voltages of the plurality of amplifiers to generate the plurality of gamma voltages.

The display device may further include a timing controller configured to output a source control signal, data, and gate control signal generated based on image information and control signals received from an outside, wherein the timing controller may collect pieces of level information regarding the bias voltage from each of the plurality of source drivers and transmit, to the plurality of source drivers, level information regarding the reference bias voltage having a lowest level among collected pieces of level information.

Each of the plurality of source drivers may further include: an analog to digital (ADC) converter configured to convert the bias voltage into a digital value; and a register storing level information regarding a converted bias voltage and the reference bias voltage.

The display device may further include a voltage generation unit configured to generate the bias voltage and the at least one reference gamma voltage.

An exemplary embodiment also discloses a method of operating a display device including a plurality of source drivers, the method including: providing a bias voltage to each of the plurality of source drivers; selecting, as a reference bias voltage, a bias voltage having a lowest level among the provided bias voltages; and adjusting a level of at least one of at least one reference gamma voltage input to a gamma voltage generation unit of each of the plurality of source drivers with reference to level information regarding the reference bias voltage.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
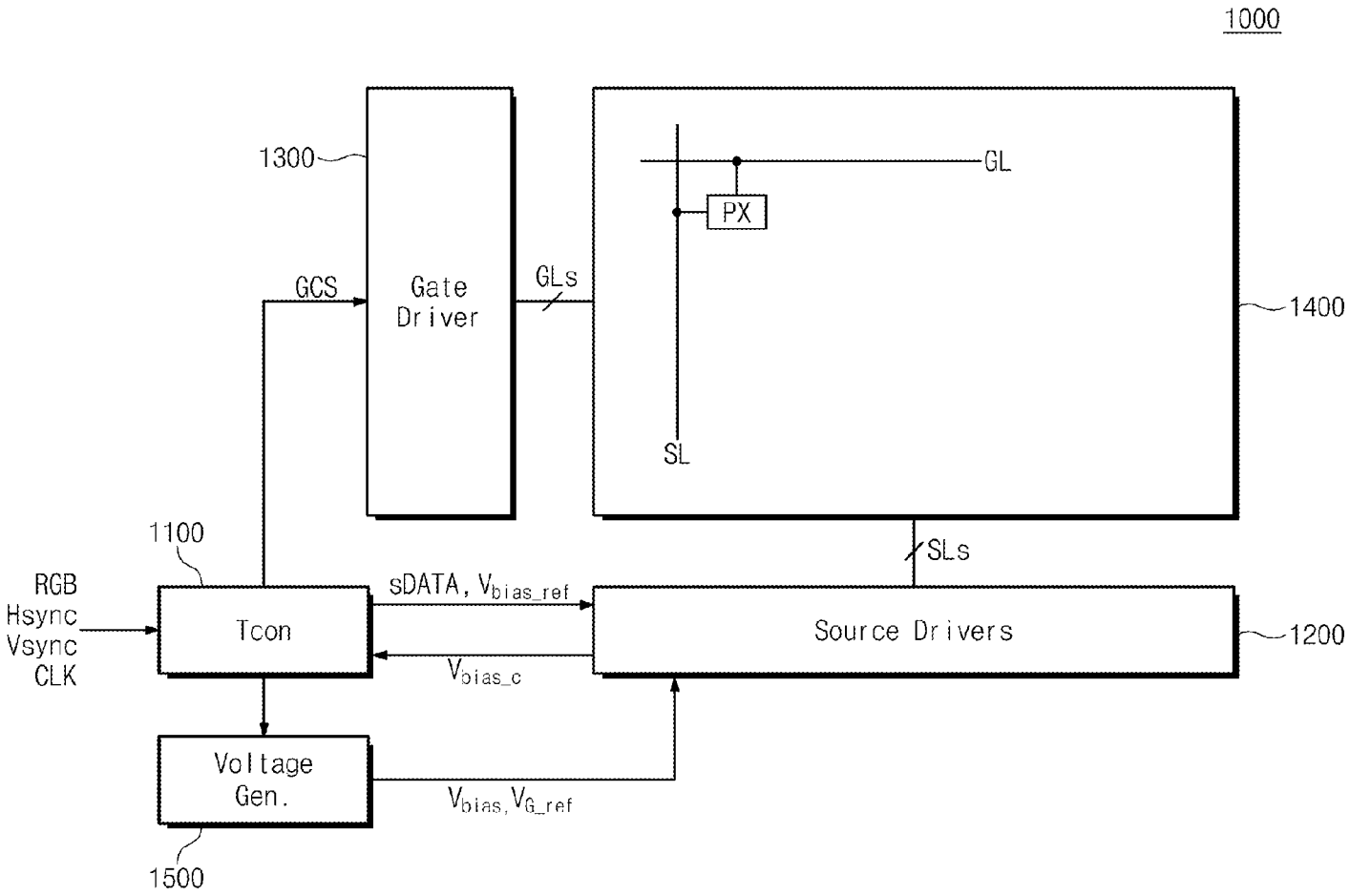
FIG. 1 is a block diagram of a display device according to an exemplary embodiment of the inventive concept.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

FIG. 1 is a block diagram of a display device according to an exemplary embodiment of the inventive concept. Referring to FIG. 1, a display device 1000 may include a timing controller 1100, source drivers 1200, a gate driver 1300, a display panel 1400, and a voltage generation unit 1500.

The timing controller 1100 may receive image information RGB and a control signal from the outside. For example, the control signal may include a vertical synchronous signal Vsync, a horizontal synchronous signal Hsync, a clock CLK, etc. The timing controller 1100 may change the format of the image information RGB to match the specifications of the source drivers 1200 to generate serial data sDATA, and transmit generated data sDATA to the source drivers 1200. The timing controller 1100 may simultaneously transmit the data sDATA and the clock CLK in an embedded clock format through a single channel. However, each of the data sDATA and the clock CLK may also be transmitted through a separate channel.

The timing controller 1100 may generate a gate control signal GCS based on the control signal and transmit a gated gate control signal GCS to the gate driver 1300. The gate control signal GCS may include a signal instructing a scan start, a signal controlling the output period of a gate ON voltage, and a signal regulating the time duration of the gate ON voltage.

The source drivers 1200 may output a grayscale voltage corresponding to received data sDATA to the display panel 1400 through source lines SLs. Each of the source drivers 1200 may be driven by a bias voltage Vbias generated by the voltage generation unit 1500. More particularly, the bias voltage Vbias may be used for driving a gamma voltage generation unit included in each source driver 1200.

The gate driver 1300 may drive gate lines GLs so that the data sDATA is sequentially output to the display panel 1400 in response to the gate control signal GCS.

The display panel 1400 may include pixels PX that are arranged on a point at which the gate lines GLs and the source lines SLs intersect. The display panel 1400 may be one of various kinds of display panels, such as an organic light-emitting diode (OLED), liquid crystal display panel (LCD), electrophoretic display panel, electrowetting display panel, and plasma display panel (PDP). However, the inventive concept is not limited thereto.

The voltage generation unit 1500 may generate reference gamma voltages $V_{G_ref}$ used for generating the bias voltage Vbias and gamma voltages needed for driving the source drivers 1200. Generated bias voltage Vbias and reference gamma voltages $V_{G_ref}$ may be provided to the plurality of source drivers 1200, respectively.

In general, a voltage drop may occur for the characteristic of the manufacturing process of the display device while the bias voltage Vbias generated by the voltage generation unit 1500 is transmitted to each source driver. In addition, since the lengths of wires receiving the bias voltage Vbias and the sizes of impedances are different from one another, the sizes of bias voltages that respective source drivers receive may be different from one another. For example, a source driver relatively distant from the voltage generation unit 1500 would receive a relatively small bias voltage. Thus, the levels of gamma voltages generated in respective source drivers may be slightly different from one another. Since the slight difference between the gamma voltage levels causes the slight difference between grayscale voltage levels, the picture quality of the display device 1000 may decrease.

In order to solve such a limitation, the source drivers 1200 may transmit information Vbias_c regarding the level of the bias voltage received by each source driver to the timing controller 1100. For example, the information Vbias_c regarding the level of the bias voltage may be a coded digital value. The timing controller 1100 may set a bias voltage having the lowest level among pieces of information Vbias_c regarding the level of the bias voltage received as a reference bias voltage Vbias_ref. In addition, the source drivers 1200 may adjust the level of the reference gamma voltage $V_{G_ref}$ used for generating a gamma voltage according to the level of the reference bias voltage Vbias_ref. As a result, since the level of gamma voltages generated by respective source drivers is the same as that of gamma voltages generated by other source drivers, a fault in picture quality of the display device 1000 is corrected and thus, the picture quality may be enhanced.

Figure 2:
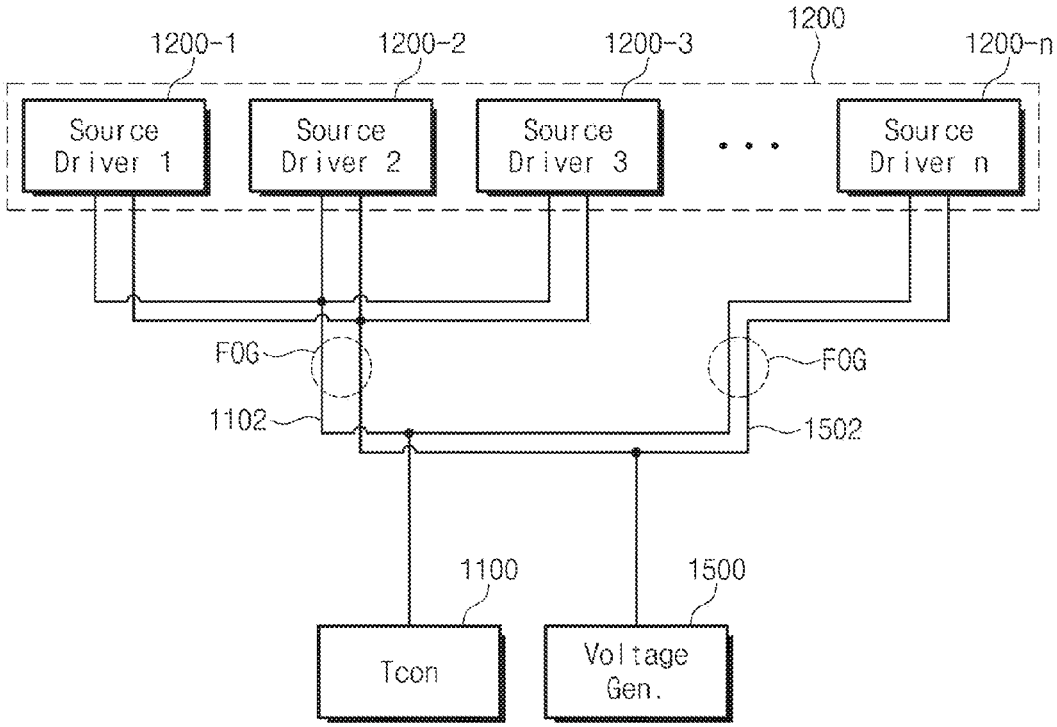
FIG. 2 is an enlarged view of a portion of the display device in FIG. 1.

FIG. 2 is an enlarged view of a portion of the display device 1000 in FIG. 1. Referring to FIG. 2, each of the plurality of source drivers 1200-1 to **1200-*n* is connected to the timing controller 1100 and the voltage generation unit 1500**.

Referring to FIG. 2, the source drivers 1200 may be bound in units of a certain number of source drivers 1200 (e.g., in units of three source drivers as shown in FIG. 2) and then connected to the timing controller 1100 and the voltage generation unit 1500. The plurality of source drivers 1200-1 to **1200-*n* may receive a control signal from the timing controller 1100 through a line 1102 or transmit the information Vbias_c regarding the level of the bias voltage to the timing controller 1100. The plurality of source drivers 1200-1 to 1200-*n* may receive the bias voltage Vbias and the reference gamma voltage $V_{G_ref}$ from the voltage generation unit 1500 through a line 1502**.

A display device generated by using a chip on glass (COG) technique may need more film on glasses (FOG) as the size of a display increases. According to an exemplary embodiment of the inventive concept, it is possible to enhance the picture quality of the display device by compensating for the difference between the levels of the bias voltages received by respective source drivers even without increasing the number of the FOGs.

Figure 3:
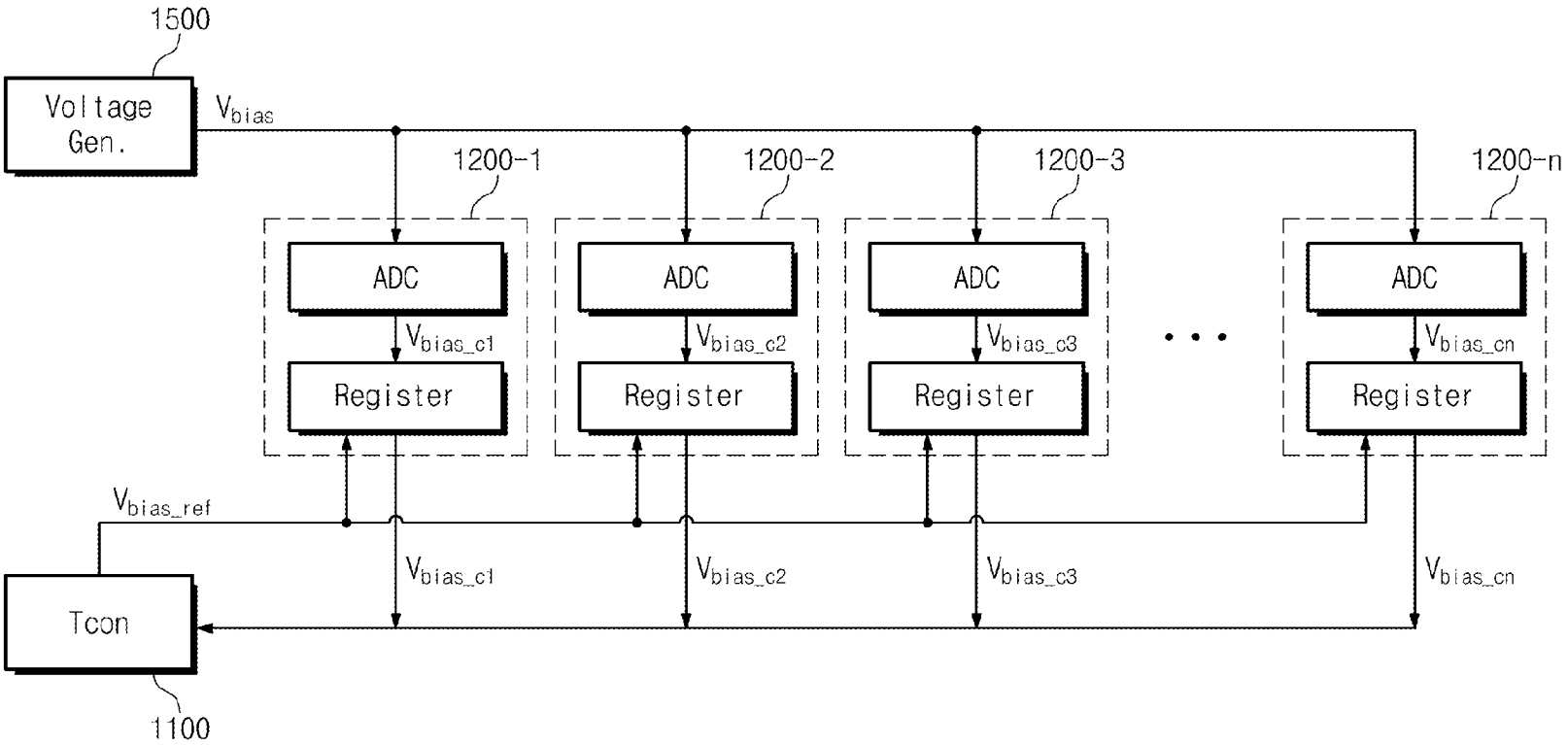
FIG. 3 is an enlarged view of FIG. 2.

FIG. 3 is an enlarged view of FIG. 2.

Referring to FIG. 3, the bias voltage Vbias generated by the voltage generation unit 1500 may be provided to a plurality source drivers 1200-1 to **1200-*n*. In addition, analog-to-digital converters (ADC) included in each source driver may convert received bias voltages Vbias into digital values Vbias_c1 to Vbias_cn. In this case, since the lengths of paths through which the bias voltages Vbias are provided and impedance values are different from one another, the sizes of bias voltages Vbias received by respective source drivers may be different from one another. The bias voltages Vbias_c1 to Vbias_cn obtained through conversion are transmitted to the timing controller 1100**.

The timing controller 1100 may set a bias voltage having the lowest level among received bias voltages Vbias_c1 to Vbias_cn as a reference bias voltage Vbias_ref. For example, the reference bias voltage Vbias_ref may be a digital value representing the level of a bias voltage. The timing controller may transmit the reference bias voltage Vbias_ref to each of the source drivers 1200-1 to **1200-*n*. In addition, each of the source drivers may adjust the level of the reference gamma voltage used for generating a gamma voltage with reference to the reference bias voltage Vbias_ref. Since the bias voltage having the lowest level is set as the reference bias voltage, the level of the reference gamma voltage would be adjusted to be low as a whole. However, the level of the bias voltage of the source driver receiving, from the voltage generation unit 1500**, the bias voltage Vbias having the same level as the reference bias voltage would not be adjusted.

Figure 4:
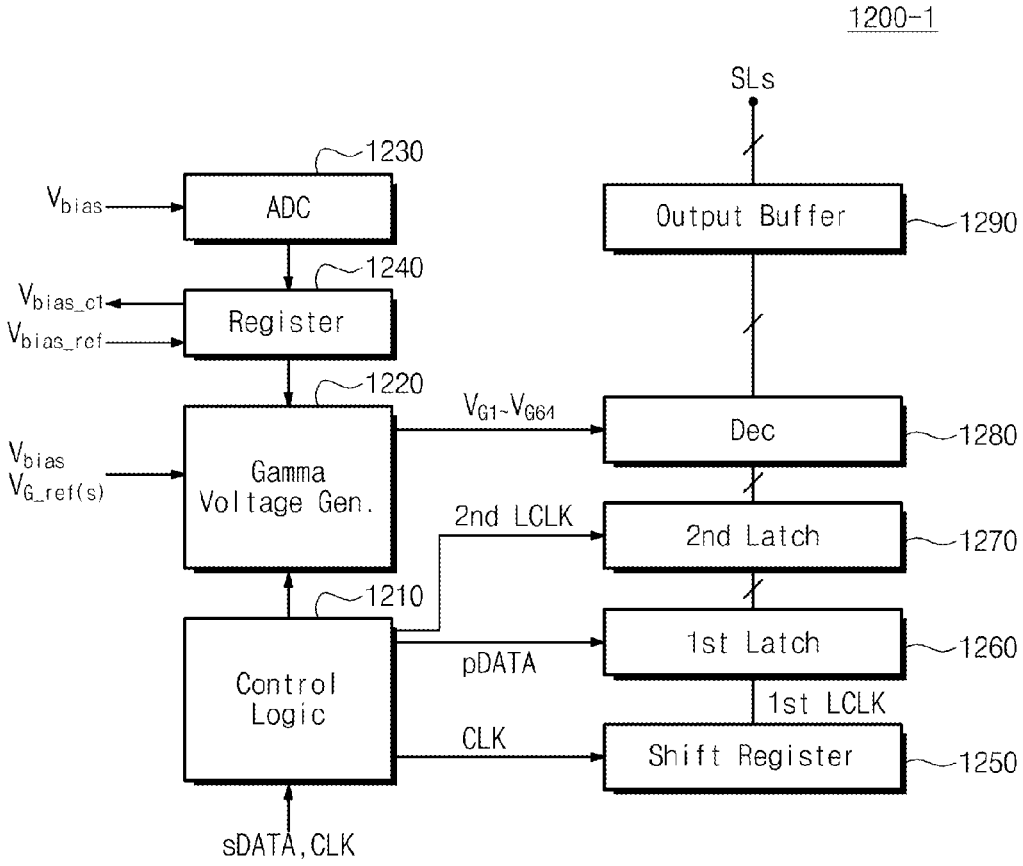
FIG. 4 is a block diagram of a first source driver in FIG. 3.

FIG. 4 is a block diagram of a first source driver 1200-1 in FIG. 3, where source drivers 1200-1 to **1200-*n* have the same mutual structure. Referring to FIG. 3, the first source driver 1200-1 may include a control logic 1210, a gamma voltage generation unit 1220, an ADC 1230, a register 1240, a shift register 1250, a first latch 1260, a second latch 1270, a decoder 1280, and an output buffer 1290**.

The control logic 1210 may control the overall operations of the first source driver 1200-1. For example, the control logic 1210 may change the serial data sDATA received from the timing controller 1100 (see FIG. 1) to parallel data pDATA. The control logic 1210 may transmit the parallel data pDATA to the first latch 1260. The control logic 1210 controls the gamma voltage generation unit 1220 so that the gamma voltage generation unit 1220 may generate a plurality of gamma voltages $V_{G1}$ to $V_{G64}$. The gamma voltages $V_{G1}$ to $V_{G64}$ may be used for converting the parallel data pDATA into data voltages (i.e., grayscale voltages).

The gamma voltage generation unit 1220 may generate gamma voltages $V_{G1}$ to $V_{G64}$ having various voltage levels according to the control of the control logic 1210. Although this example shows that 6-bit gamma voltages are generated, the number of generated reference gamma voltages is not limited thereto. The gamma voltage generation unit 1220 may receive the bias voltage Vbias and the reference gamma voltage $V_{G_ref}$ from the voltage generation unit 1500 (see FIG. 1). A plurality of amplifiers configuring the gamma voltage generation unit 1220 is driven by the bias voltage Vbias. The gamma voltage generation unit 1220 may use the reference gamma voltages $V_{G_ref}$ to generate the gamma voltages $V_{G1}$ to $V_{G64}$.

According to an exemplary embodiment of the inventive concept, the gamma voltage generation unit 1220 may adjust the level of the bias voltage Vbias with reference to the reference bias voltage Vbias_ref received from the timing controller 1100 (see FIG. 1). For example, a received reference bias voltage Vbias_ref may be level information on a bias voltage having the lowest level among bias voltages received by a plurality of source drivers. As an example, FIG. 4 shows that the reference bias voltage Vbias_ref is stored in the register 1240 and then transmitted to the gamma voltage generation unit 1220. However, the inventive concept is not limited thereto and the gamma voltage generation unit 1220 may receive the reference bias voltage Vbias_ref directly from the timing controller.

The ADC 1230 may convert the level of the bias voltage Vbias provided to the gamma voltage generation unit 1220 into a digital value (i.e., Vbias_c1).

The register 1240 may store the bias voltage Vbias_c1 being the digital value. The register 1240 may transmit the bias voltage Vbias_c1 obtained through conversion to the timing controller 1100 (see FIG. 1). Then, the timing controller 1100 (see FIG. 1) may set, as the reference bias voltage $V_{G_ref}$, a bias voltage having the lowest level among converted bias voltages received from the plurality of source drivers 1200-1 to **1200-*n* (see FIG. 2). The register 1240** may receive the reference bias voltage $V_{G_ref}$.

The shift register 1250 may generate a first latch clock 1st LCLK based on a clock CLK. The first latch clock 1st LCLK may control a timing at which the parallel data pDATA stored in the second latch 1270 via the first latch 1260 is output to the display panel 1400 (see FIG. 1).

The first latch 1260 may temporarily store the parallel data pDATA received from the control logic 1210. The parallel data pDATA may be sequentially stored in the first latch 1260 to correspond to a location to be output to a display panel. The first latch 1260 may transmit latched data pDATA to the second latch 1270 at a desired timing according to the control of the first latch clock 1st LCLK received from the shift register 1250.

The second latch 1270 may receive the parallel data pDATA stored in the first latch 1260. The second latch 1270 may receive the second latch clock 2nd LCLK from the control logic 1210 and transmit the parallel data pDATA to the decoder 1280.

The decoder 1280 may use the gamma voltages $V_{G1}$ to $V_{G64}$ received from the gamma voltage generation unit 1220 to convert the data pDATA transmitted to the decoder 1280 into a data voltage (i.e., grayscale voltage).

The output buffer 1290 may include a plurality of source amplifiers. Each of the source amplifiers may receive the data voltage received from the decoder 1280 and output the received data voltage to the display panel 1400 (see FIG. 1). Red, green, and blue data may be sequentially outputted through each of channels connected to the output buffer.

Figure 5:
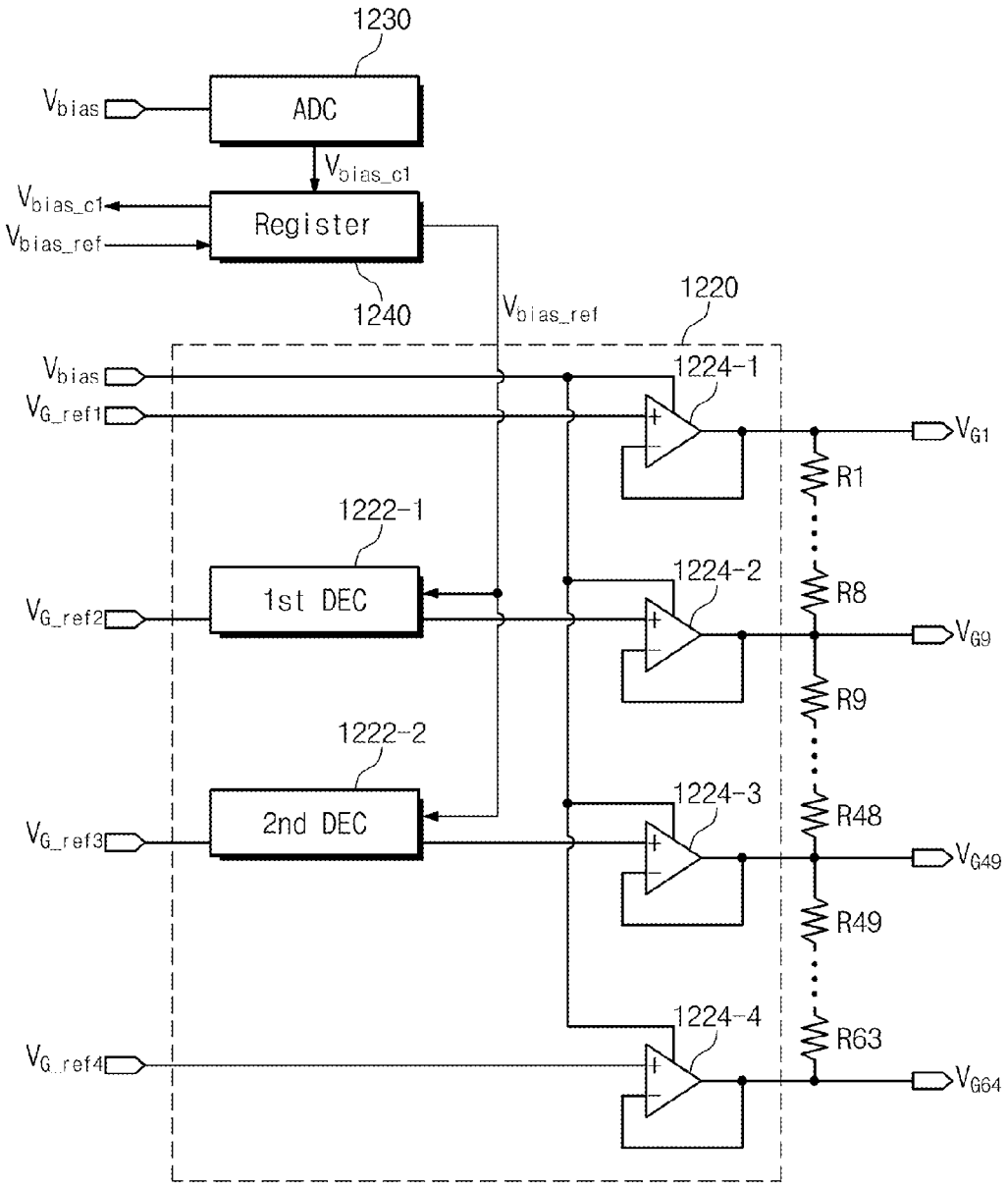
FIG. 5 is an enlarged view of a portion of the first source driver in FIG. 4.

FIG. 5 is an enlarged view of a portion of the first source driver in FIG. 4. In FIG. 5, the gamma voltage generation unit 1220, the ADC 1230, and the register 1240 are shown.

The gamma voltage generation unit 1220 may include a plurality of decoders 1222-1 and 1222-2, a plurality of amplifiers 1224-1 to 1224-4, and a plurality of resistors R1 to R63.

The gamma voltage generation unit 1220 may receive the plurality of reference gamma voltages $V_{G_ref1}$ to $V_{G_ref4}$ generated by the voltage generation unit 1500 (see FIG. 3). The plurality of reference voltages $V_{G_ref1}$ to $V_{G_ref4}$ may be used as references in generating the gamma voltages $V_{G1}$ to $V_{G64}$. Although FIG. 5 shows that 4 reference gamma voltages are received to generate 64 gamma voltages, the inventive concept is not limited thereto. The gamma voltage generation unit 1220 may receive the bias voltage Vbias generated by the voltage generation unit 1500 (see FIG. 3).

Also, the ADC 1230 may receive the bias voltage Vbias and convert it into a digital value Vbias_c1. The bias voltage Vbias_c1 obtained through conversion is stored in the register 1240 and then transmitted to the timing controller 1100 (see FIG. 3). Then, the timing controller 1100 (see FIG. 3) may set the lowest of received bias voltages Vbias_c1 to Vbias_cn as the reference bias voltage Vbias_ref. The timing controller 1100 (see FIG. 3) may transmit the reference bias voltage Vbias_ref to each source driver. FIG. 5 shows that information rergarding a received reference bias voltage Vbias_ref is stored in the register 1240.

The plurality of decoders 1222-1 and 1222-2 may adjust the level of the reference gamma voltages $V_{G_ref}$ with reference to the reference bias voltage Vbias_ref. For example, the decoders may adjust the level of remaining reference gamma voltages (i.e., $V_{G_ref2}$ and $V_{G_ref3}$) excluding reference gamma voltages having the lowest level and the highest level $V_{G_ref1}$ and $V_{G_ref4}$. For example, the decoder 1222-1 may adjust the level of the reference gamma voltage $V_{G_ref2}$ received from the voltage generation unit 1500 (see FIG. 3) to be a little low. In addition, the decoder 1222-2 may adjust the level of the reference gamma voltage $V_{G_ref3}$ received from the voltage generation unit 1500 (see FIG. 3) to be a little low. The reason for these is because a bias voltage having the lowest level among bias voltages received by respective source drivers is set as the reference bias voltage Vbias. The level of a reference gamma voltage provided to a source driver that receives the bias voltage having the lowest level would not be adjusted.

The plurality of amplifiers 1224-1 to 1224-4 may use the reference gamma voltages or adjusted reference gamma voltages $V_{G_ref1}$ to $V_{G_ref4}$ to gamma voltages $V_{G1}$, $V_{G9}$, $V_{G49}$, and $V_{G64}$, respectively. The gamma voltages $V_{G1}$, $V_{G9}$, $V_{G49}$, and $V_{G64}$ may be divided by the resistors R1 to R63 disposed at the output end of the plurality of amplifiers 1224-1 to 1224-4. As a result, the plurality of gamma voltages $V_{G1}$ to $V_{G64}$ is generated.

According to an exemplary embodiment of the inventive concept, the level of reference bias voltages provided to respective source drivers may be adjusted. As a result, the gamma voltages generated by respective source drivers have the same level as those generated by other source drivers. As a result, the picture quality of the display device may be enhanced.

Figure 6:
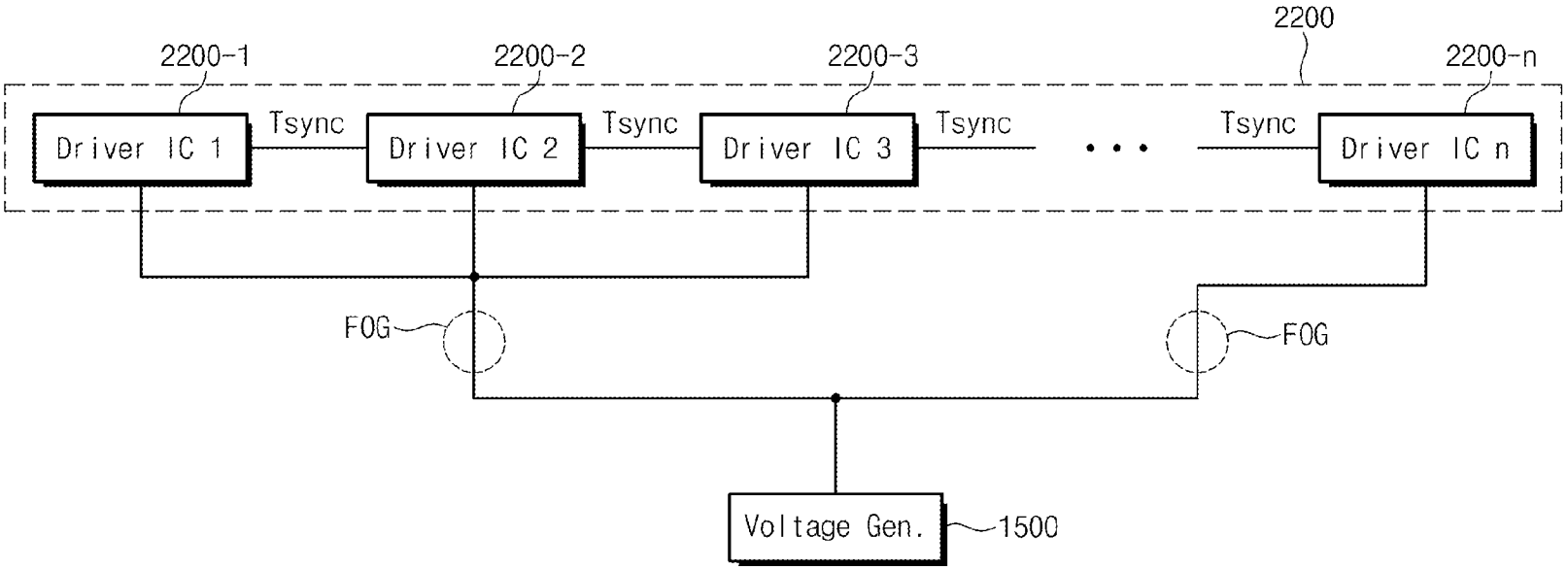
FIG. 6 is an enlarged view of a portion of the display device in FIG. 1 according to another exemplary embodiment.

FIG. 6 is an enlarged view of a portion of the display device 1000 in FIG. 1 according to another exemplary embodiment. FIG. 6 represents when the timing controller 1100 in FIG. 1 is embedded in each of the source drivers 1200. That is, each of drivers ICs 2200-1 to **2200-*n*** may include the timing controller.

Referring to FIG. 6, each of the driver ICs 2200-1 to **2200-*n* may receive a bias voltage and reference gamma voltages from the voltage generation unit 1500**. Each driver IC is connected to adjacent driver ICs. As such, when the timing controller is embedded in each driver IC, each driver IC may have a function of correcting the synchronization between embedded timing controllers.

Each of the driver ICs 2200-1 to **2200-*n* may transmit and receive a Tsync signal to and from another driver IC and use a received Tsync signal to adjust the synchronization of an output signal from the timing controller. In this case, the Tsync signal may include information on the level of a bias voltage that each driver IC receives from the voltage generation unit 1500. Each of the driver ICs 2200-1 to 2200-*n* may use the Tsync signal to receive information on the reference bias voltage Vbias_ref as shown in FIG. 4. In addition, each of the driver ICs 2200-1 to 2200-*n* may adjust the level of the reference gamma voltage used for generating a gamma voltage with reference to the reference bias voltage Vbias_ref. According to an exemplary embodiment, any one of the plurality of driver ICs 2200-1 to 2200-*n* may be set as a master driver IC, which may also control the timing controller embedded in another driver IC. In the following, repetitive descriptions are omitted because the descriptions are similar to those provided in FIGS. 1 to 5**.

Figure 7:
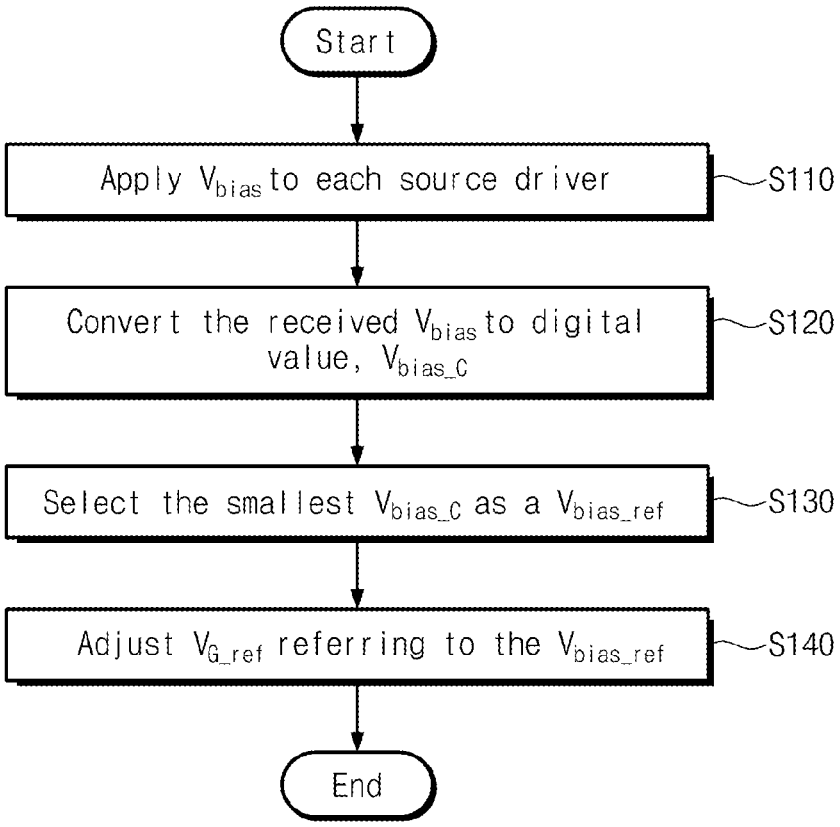
FIG. 7 is a flow chart of a method of adjusting the level of a reference gamma voltage used for generating a gamma voltage according to an exemplary embodiment of the inventive concept.

FIG. 7 is a flow chart of a method of adjusting the level of a reference gamma voltage used for generating a gamma voltage according to an exemplary embodiment of the inventive concept.

In step S110, a bias voltage Vbias may be applied to each of a plurality of source drivers. The bias voltage Vbias may be used for driving the gamma voltage generation unit of the source driver.

In step S120, the bias voltage provided to each of the plurality of source drivers may be converted into a digital value Vbias_c. This step may be performed by an ADC provided to each of the source drivers. The bias voltage Vbias_c obtained through conversion may be stored in a separate register and transmitted to a timing controller.

In step S130, a bias voltage having the lowest level among the bias voltages Vbias_c obtained through conversion may be selected as a reference bias voltage Vbias_ref. This step may be performed by collecting the bias voltage Vbias_c obtained through conversion, from each source driver and selecting the reference bias voltage Vbias_ref among them, by the timing controller. A selected reference bias voltage Vbias_ref may be transmitted back to each source driver.

In step S140, a reference gamma voltage $V_{G_ref}$ may be adjusted with reference to a received reference bias voltage Vbias_ref. This step may be performed by the gamma voltage generation of each of the plurality of source drivers. For example, since a bias voltage having the lowest level is selected as the reference bias voltage Vbias_ref, the reference gamma voltage $V_{G_ref}$ may be adjusted to have a slightly lower level than an input reference gamma voltage.

Thus, the gamma voltages generated by respective source drivers have the same level as those generated by other source drivers. As a result, the picture quality of a display device may be enhanced.

Figure 8:
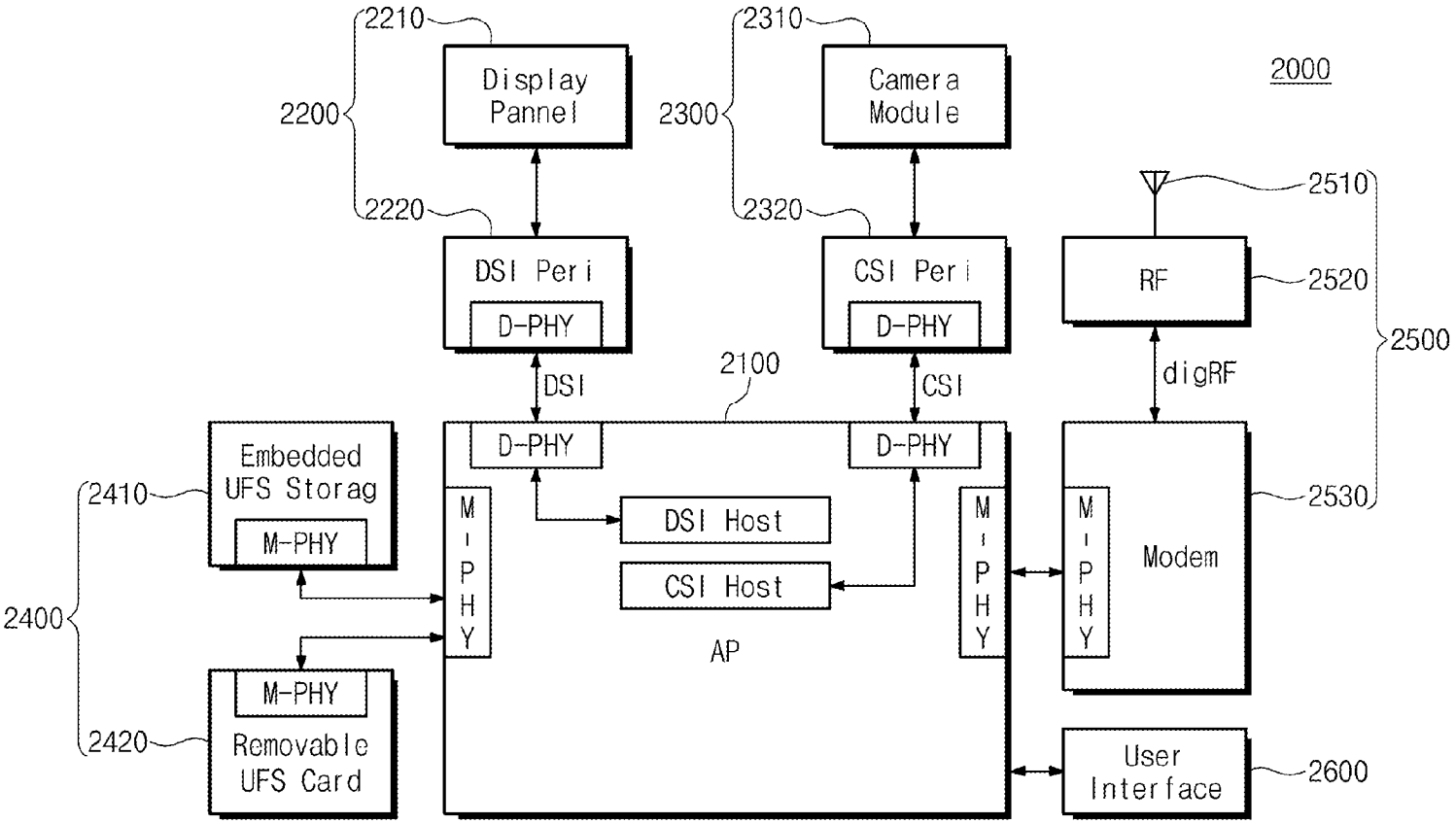
FIG. 8 is a block diagram of a mobile device to which the inventive concept is applied.

FIG. 8 is a block diagram of a mobile device to which the inventive concept is applied. Referring to FIG. 8, a mobile device 2000 may be configured to be capable of supporting a mobile industry processor interface (MIPI) standard or embedded displayport (eDP) standard. The mobile device 2000 may include an application processor 2100, a display unit 2200, an image processing unit 2300, a data storage 2400, a wireless transmission/reception unit 2500, and a user interface 2600.

The display unit 2200 may include a display panel 2210 and a display serial interface (DSI) peripheral circuit 2220. The display panel 2210 may display image data. A DSI host embedded in the application processor 2100 may perform serial communication with the display panel 2210 through DSI. The DSI peripheral circuit 2220 may include a timing controller, source driver, and gate driver that are needed for driving the display panel 210. The DSI peripheral circuit may perform a function of adjusting the level of a reference gamma voltage according to an embodiment of the inventive concept. As a result, the picture quality of the display panel 2210 may be enhanced.

The image processing unit 2300 may include a camera module 2310 and a camera serial interface (CSI) peripheral circuit 2320. The camera module 2310 and the CSI peripheral circuit 2320 may include a lens, an image sensor, and an image processor. Image data created at the camera module 2310 may be processed by the image processor and a processed image may be transmitted to the application processor 2100 through CSI.

The data storage 2400 may include an embedded universal flash storage (UFS) storage 2410 and a removable UFS card 2420. The embedded UFS storage 2410 and the removable UFS card 2420 may perform communication with the application processor 2100 through a multi-band physical (M-PHY) layer. The host (application processor) 2100 may include a bridge to communicate with the removable UFS card 2420 by using other protocols excluding an UFS protocol. The application processor 2100 and the removable UFS card 2420 may communicate by using various card protocols (e.g., UFDs, multi-media card (MMC), eMMC secure digital (eMMC SD), mini SD, and Micro SD). The embedded UFS storage 2410 and the removable UFS card 2420 may include a 3D non-volatile memory device in which a cell string to be connected to a memory cell is formed perpendicular to a substrate. Information on each memory block may be stored in the meta regions of the embedded UFS storage 2410 and the removable UFS card 2420.

The wireless transmission/reception unit 2500 may include an antenna 2510, an RF unit 2520, and a modem 2530. The modem 2530 is shown as communicating with the application processor 2100 through the M-PHY layer. However, the modem 2530 may be embedded in the application processor 2100 according to an embodiment.

According to an exemplary embodiment of the inventive concept, it is possible to adjust the level of reference gamma voltages used for generating a gamma voltage to allow source drivers to output reference gamma voltages having the same level.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display device comprising a plurality of source drivers, wherein each of the plurality of source drivers comprises a gamma voltage generator configured to be driven by a bias voltage and generate a plurality of gamma voltages by using at least one reference gamma voltage, wherein:

the display device further comprises a voltage generator configured to generate the bias voltage and the at least one reference gamma voltage, a same bias voltage having a single level being sent to each one of the plurality of source drivers;

at least one of the at least one reference gamma voltage is adjusted with reference to level information regarding a reference bias voltage;

the reference bias voltage is a bias voltage having a lowest level among bias voltages received by each one of the plurality of source drivers; and the gamma voltage generator comprises a decoder configured to adjust a level of at least one of the at least one reference gamma voltage with reference to the level information regarding the reference bias voltage.

2. The display device of claim 1, wherein a level of the adjusted reference gamma voltage is lower than a level of a reference gamma voltage prior to adjustment.

3. The display device of claim 1, wherein a level of the plurality of gamma voltages generated by the gamma voltage generator is the same as a level of the plurality of gamma voltages generated by the gamma voltage generations of other source drivers.

4. The display device of claim 3, wherein a level of at least one reference gamma voltage provided to a source driver receiving a bias voltage having a same level as the reference bias voltage is not adjusted.

5. The display device of claim 1, wherein the gamma voltage generator further comprises:

a plurality of amplifiers configured to receive and output the adjusted reference gamma voltage or the at least one reference gamma voltage; and a plurality of resistors connected to output ends of the plurality of amplifiers and dividing output voltages of the plurality of amplifiers to generate the plurality of gamma voltages.

6. The display device of claim 1, further comprising a timing controller configured to output a source control signal, data control signal, and gate control signal generated based on image information and control signals received, wherein the timing controller is configured to collect level information regarding the bias voltage from each of the plurality of source drivers and transmit, to the plurality of source drivers, level information regarding the reference bias voltage having a lowest level among collected level information.

7. The display device of claim 6, wherein each of the plurality of source drivers further comprises:

an analog to digital (ADC) converter configured to convert the bias voltage into a digital value; and a register storing level information regarding a converted bias voltage and the reference bias voltage.

8. A method of operating a display device comprising a plurality of source drivers, the method comprising:

sending a same bias voltage having a single level to each of the plurality of source drivers;

storing level information on the bias voltage;

collecting level information regarding a stored bias voltage;

selecting, as a reference bias voltage, a bias voltage having a lowest level among bias voltages received by the plurality of source drivers; and adjusting a level of at least one of at least one reference gamma voltage inputted to a gamma voltage generator of each of the plurality of source drivers with reference to level information regarding the reference bias voltage.

9. The method of claim 8, wherein a level of the adjusted reference gamma voltage is lower than a level of a reference gamma voltage before adjustment.

10. The method of claim 8, further comprising generating a plurality of gamma voltages by using the adjusted reference gamma voltage or the at least one reference gamma voltage.

11. The method of claim 10, wherein a level of the plurality of gamma voltages is the same as a level of a plurality of gamma voltages generated by other source drivers.

12. The method of claim 11, wherein a level of a reference gamma voltage provided to a source driver receiving a bias voltage having a same level as the reference bias voltage is not adjusted.

* * * * *